US006575761B1

(12) United States Patent
Regnier

(10) Patent No.: US 6,575,761 B1
(45) Date of Patent: Jun. 10, 2003

(54) COAXIAL CONNECTOR MODULE AND METHOD OF FABRICATING SAME

(75) Inventor: Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/651,634

(22) Filed: Aug. 30, 2000

(51) Int. Cl.[7] ..... H01R 12/00

(52) U.S. Cl. ..... 439/63; 439/581; 439/608; 439/108

(58) Field of Search ..... 439/63, 581, 608, 439/108, 578, 579

(56) References Cited

U.S. PATENT DOCUMENTS

| | | | | |
|---|---|---|---|---|
| 5,116,245 A | | 5/1992 | Baker | 439/581 |
| 5,169,343 A | | 12/1992 | Andrews | 439/608 |
| 5,344,340 A | | 9/1994 | Bouleau | 439/581 |
| 5,516,307 A | | 5/1996 | Cartesse et al. | 439/581 |
| 5,577,935 A | | 11/1996 | Harting et al. | 439/581 |
| 5,679,006 A | | 10/1997 | Madelaine | 439/63 |
| 5,851,121 A | * | 12/1998 | Thenaisie et al. | 439/63 |
| 6,071,127 A | | 6/2000 | Acke et al. | 439/63 |
| 6,305,947 B1 | * | 10/2001 | Bruce | 439/581 |

* cited by examiner

*Primary Examiner*—Tho D. Ta
(74) *Attorney, Agent, or Firm*—A. A. Tirva; Stacey E. Caldwell

(57) ABSTRACT

An angular coaxial connector module (12) is provided for installation on a printed circuit board. The module includes at least a pair of angled coaxial conductors (28,30) each including first and second legs (32,34) joined at an elbow (36). The distal end **(32*a*) of each first leg (32) defines a contact end of the respective conductor. The distal end (34*a*) of each second leg (34) defines a terminal end for attachment to the printed circuit board. A dielectric sheath (26) is disposed about each angled coaxial conductor leaving the distal ends thereof exposed. A tubular conductive shield (14,38) is provided about each dielectric sheath. A grounding means (18,60) couples the shields to the printed circuit board. A unitary dielectric housing (16) is disposed about at least portions (38) of the shields (14,38)** to hold the connector in a module.

28 Claims, 8 Drawing Sheets

COAXIAL CONNECTOR MODULE AND METHOD OF FABRICATING SAME

FIELD OF THE INVENTION

This invention generally relates to the art of electrical connectors and, particularly, to an angular coaxial connector module for installation on a printed circuit board, along with a method of fabricating the module.

BACKGROUND OF THE INVENTION

In high frequency connectors, such as RF coaxial connector modules, it is particularly important to electrically shield the conductors of the module from ingress or egress of electromagnetic interference (EMI) or radio frequency interference. It also is important to prevent any crosstalk between the signals carried by two adjacent conductors. Consequently, coaxial connector modules typically have some form of elaborate shielding system about the conductors.

One type of coaxial connector module is an angled connector module which has at least two conductors each having generally perpendicular legs joined at an elbow. Such connector modules interconnect electrical components that are disposed at angles to each other. For instance, an angular coaxial connector module may interconnect a first printed circuit board arranged perpendicularly to a second printed circuit board. In printed circuit board technology, multiple coaxial plug connectors, particularly coaxial connector modules such as the angled coaxial connector modules, are used in a high packing density. Therefore, proper shielding of the conductors is absolutely necessary in such high density environments. Heretofore, insulated coaxial conductors of coaxial connector modules typically have been surrounded by a substantial unitary shielding housing which surrounds all of the conductors of the module. These shielding housings are relatively massive, elaborate, cumbersome and expensive. The present invention is directed to providing a simple and efficient angular coaxial connector module wherein the individual insulated conductors are simply individually shielded and the assembly is modularized by a simple. overmolded dielectric housing.

SUMMARY OF THE INVENTION

An object, therefore, of the invention is to provide a new and improved angular coaxial connector module for installation on a printed circuit board.

Another object of the invention is to provide a new and improved method of fabricating an angular coaxial connector module of the character described.

In the exemplary embodiment of the invention, the angular coaxial connector module includes at least a pair of angled coaxial conductors each including first and second legs joined at an elbow. This distal end of the first leg of each conductor defines a contact end. The distal end of the second leg of each conductor defines a terminal end for attachment to the printed circuit board. A dielectric sheath is disposed about each angled coaxial conductor, leaving the distal ends thereof exposed. A tubular shield is disposed about each dielectric sheath. Grounding means are provided for coupling the shields to the printed circuit board. A unitary dielectric housing is disposed about at least portions of the shields to hold the connector assembly in a module.

As disclosed herein, the dielectric sheaths are overmolded in tubular form about the angled coaxial conductors. The dielectric housing is a one-piece plastic structure overmolded about at least portions of the shields. The grounding means comprises at least one grounding clip having at least one tail portion for attachment to the printed circuit board. One type of grounding clip includes a body portion embracing the conductive shields of both coaxial conductors. Individual grounding clips also may be provided for embracing each individual conductive shield.

In the preferred embodiment, each of the tubular conductive shields about a respective one of the angled coaxial conductors, includes an axially split, L-shaped shield portion about one leg and the elbow of the respective conductor, leaving the distal end of the one leg exposed. Each shield further includes a circumferentially continuous shield portion about the other leg of the respective conductor leaving the distal end of the other leg exposed. The circumferentially continuous portion of each shield has an end surrounding an adjacent end of the axially split portion of the shield to hold the axially split portion together.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
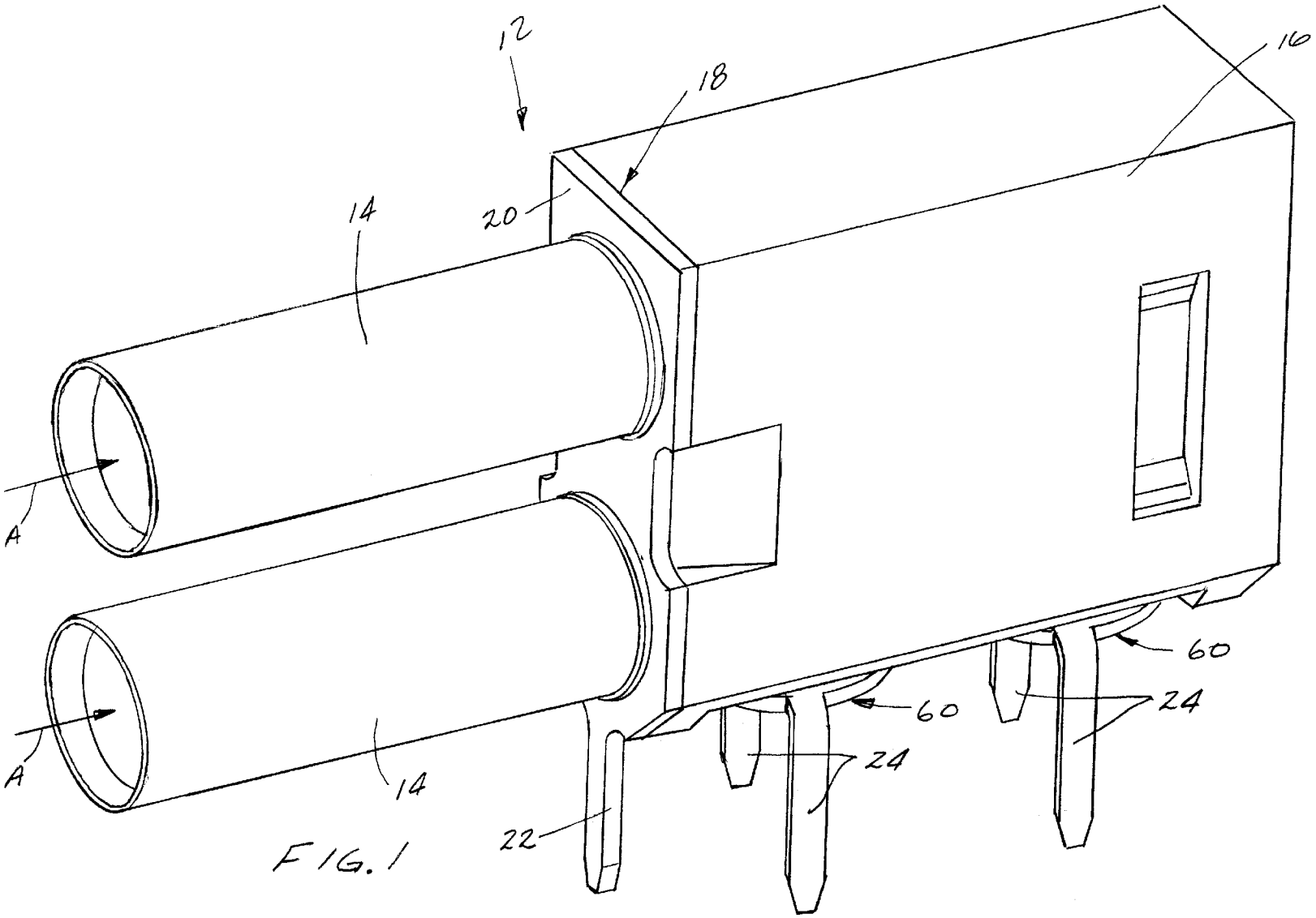
FIG. 1 is a perspective view of an angular coaxial connector module embodying the concepts of the invention.

Referring to the drawings in greater detail, and first to FIG. 1, the invention is embodied in an angular coaxial connector module, generally designated 12. The module is configured for installation on a printed circuit board. FIG. 1 shows the front portions 14 of the tubular conductive shields which surround a pair of angled coaxial conductors, as will be described hereinafter. The front portions of the shields project outwardly of a one-piece overmolded plastic housing 16. A grounding clip, generally designated 18, includes a body portion 20 which embraces the two tubular shields, and a tail portion 22 for insertion into a hole in the printed circuit board and for electrical connection, as by soldering, to a ground circuit on the board and/or in the hole. A plurality of tail portions 24 of an additional pair of grounding clips (described hereinafter) project downwardly from overmolded housing 16, also for insertion into appropriate holes in the printed circuit board.

The remaining figures of the drawings show sequential views in fabricating angular coaxial connector module 12. Therefore, the method of fabricating the module according to the invention will be incorporated in the following description as the sequential figures are described.

Figure 2:
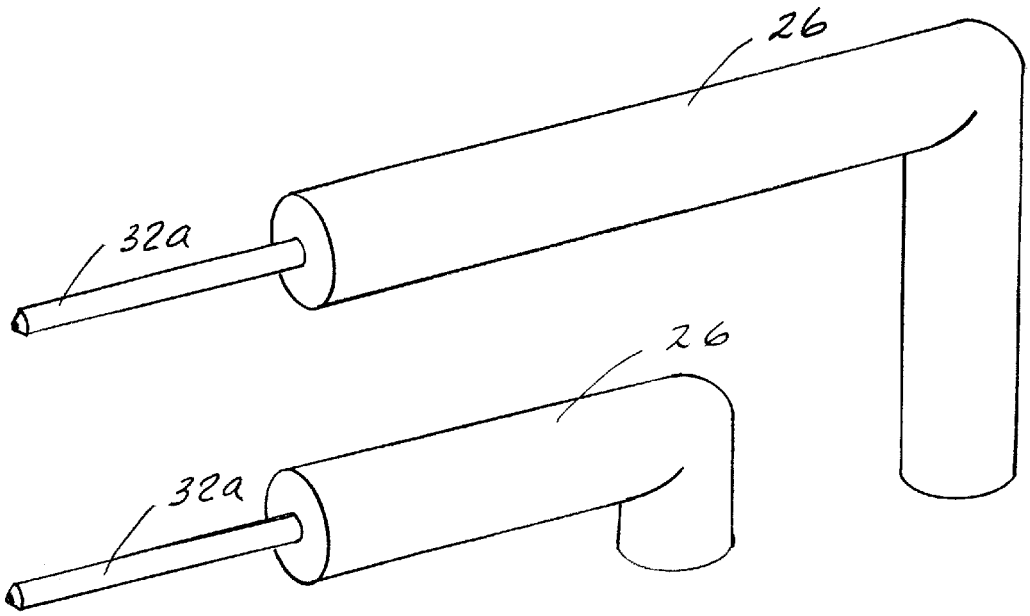
FIG. 2 is a perspective view of a pair of angled coaxial conductors of the module covered by dielectric sheaths.
Figure 7:
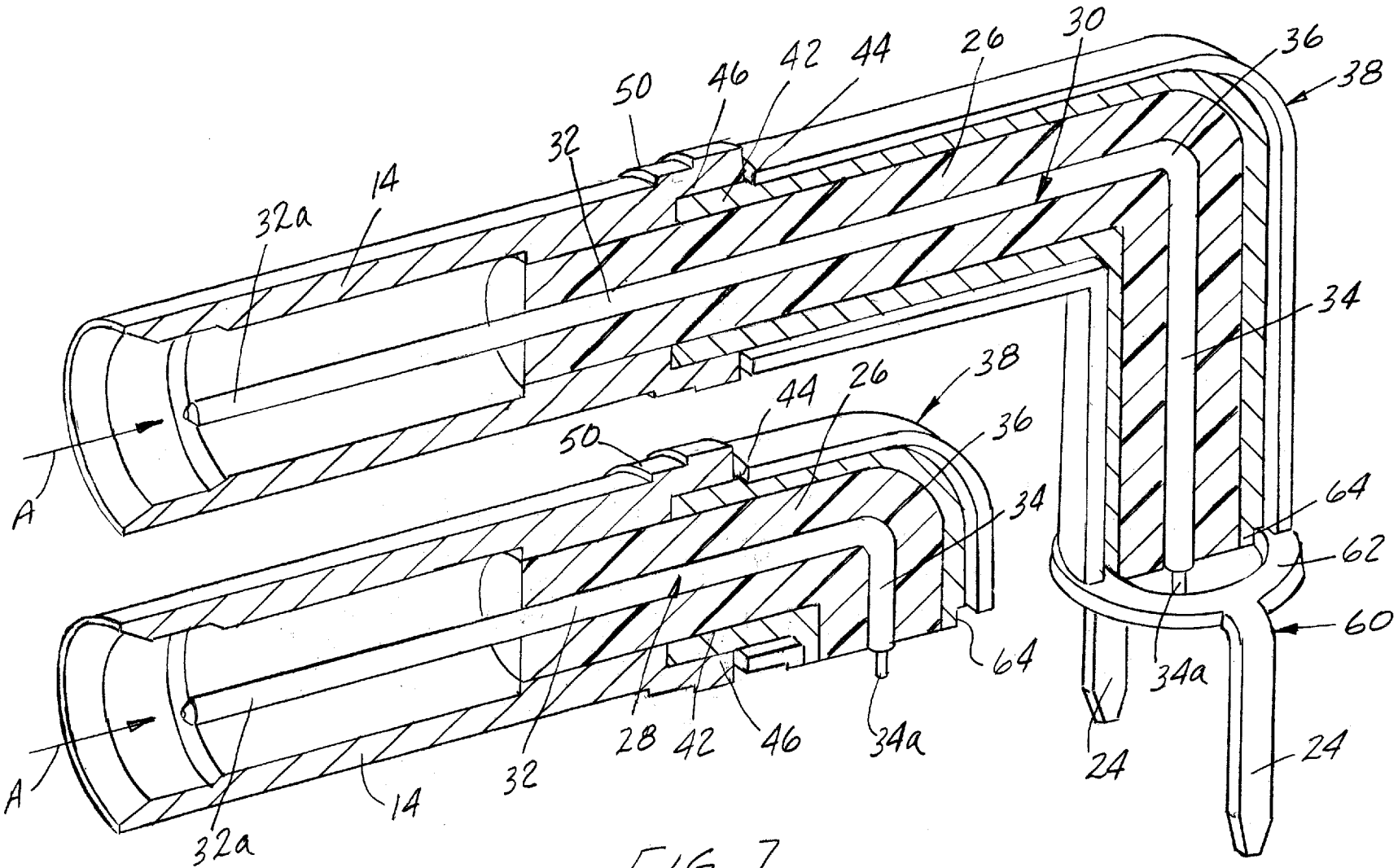
FIG. 7 is a view similar to that of FIG. 6, but in axial section and with the grounding clip for the inside conductor removed.

With that understanding, FIG. 2 shows the first fabrication step which is to overmold a one-piece, L-shaped dielectric sheath 26 about each of the pair of coaxial conductors of the module. Before proceeding, reference is made to FIG. 7 where the full extent of a pair of angled coaxial conductors, including an inside conductor generally designated 28 and an outside conductor generally designated 30, are shown in their full extent. Each conductor includes first and second legs 32 and 34, respectively, joined at a right-angular elbow 36. Legs 32 have distal ends 32*a* exposed outside sheaths 26. Legs 34 have distal ends 34*a* exposed outside sheaths 26. Distal ends 32*a* of legs 32 are disposed within front portions 14 of the tubular shields of the module for connection to the female contacts of an appropriate mating connecting device having portions inserted in the direction of arrows "A" (FIG. 7). Distal ends 34*a* of legs 34 are provided for attachment to appropriate circuit traces on the printed circuit board, as will be described hereinafter.

Figure 3:
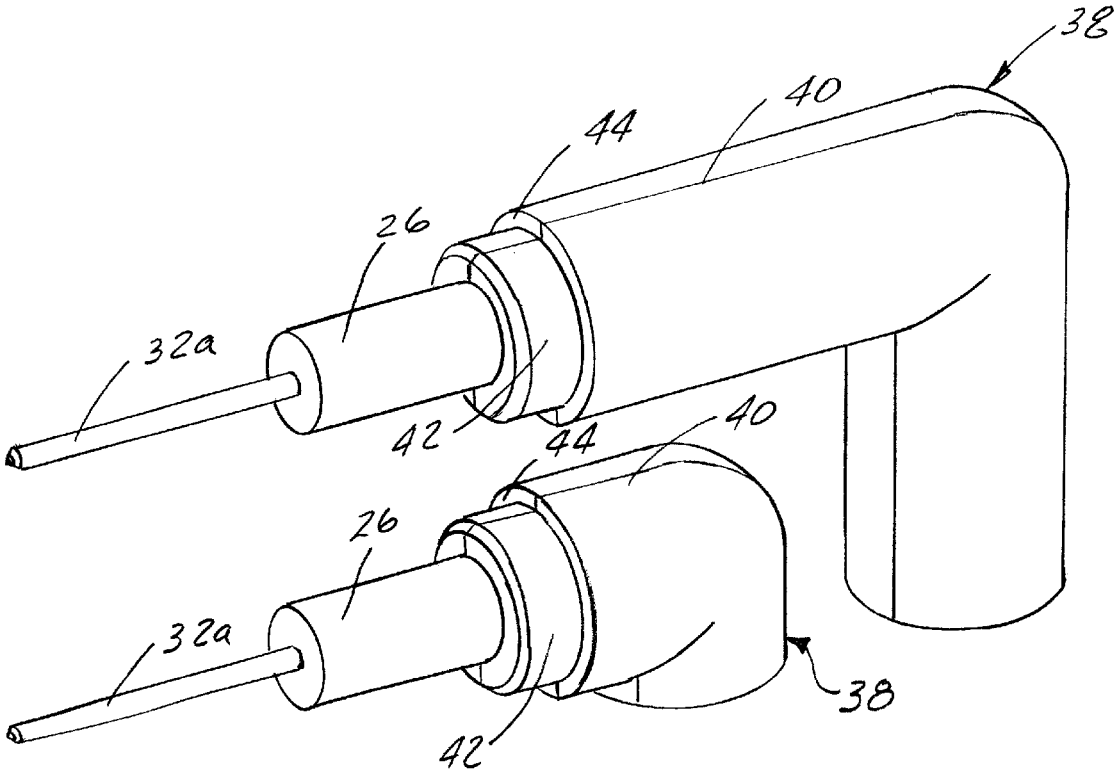
FIG. 3 is a perspective view of the covered conductors of FIG. 3 embraced by the rear, axially split portions of the shields of the module.

After conductors 30 are overmolded with dielectric sheaths 26 as seen in FIG. 2, a pair of axially split, L-shaped rear shield portions, generally designated 38, of the tubular shields of the module are positioned about dielectric sheaths 26 as seen in FIG. 3. Each rear shield portion 38 of each tubular shield is axially split, as at 40, to define two L-shaped semi-tubular portions which are joined together to surround legs 34 and elbows 36 (FIG. 7) of angled coaxial conductors 30, as well as to surround substantial portions of legs 32 of the conductors, as seen by the L-shaped configurations of the rear shield portions shown in FIG. 3. It can be seen that rear shield portions 38 have reduced-diameter portions 42 at the upper, forwardly facing ends thereof. The reduced-diameter portions form ring-like shoulders 44.

Figure 4:
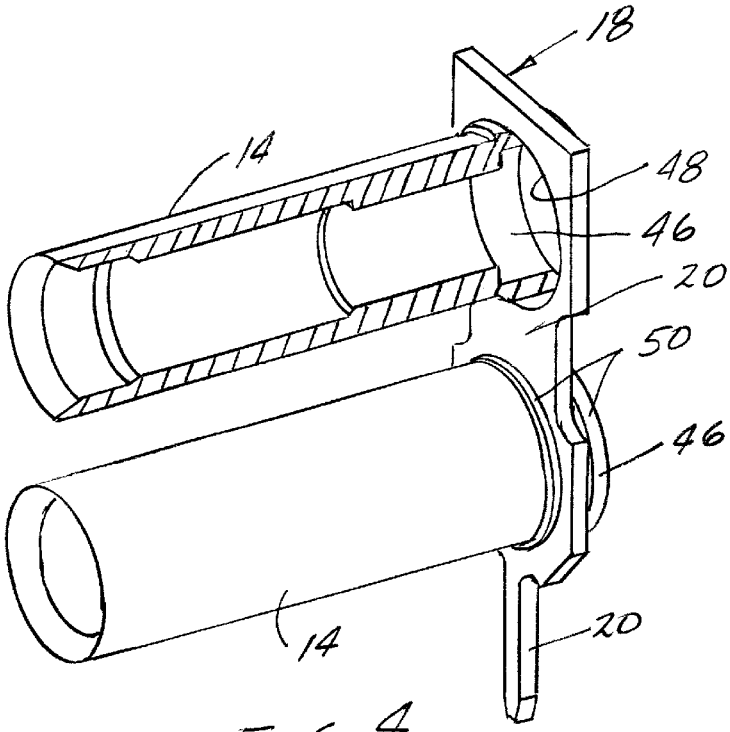
FIG. 4 is a perspective view, partially cut away, showing the front portions of the shields assembled to a grounding clip.

The next step is shown in FIG. 4 wherein rear ends 46 of front shield portions 14 are inserted through holes 48 in body portion 20 of grounding clip 18. Each front shield portion 14 has a circular, outwardly projecting flange 50 against which the grounding clip abuts. It should be noted that front shield portions 14 are circumferentially continuous in cylindrical form, versus the axially split structure of rear shield portions 38.

Figure 5:
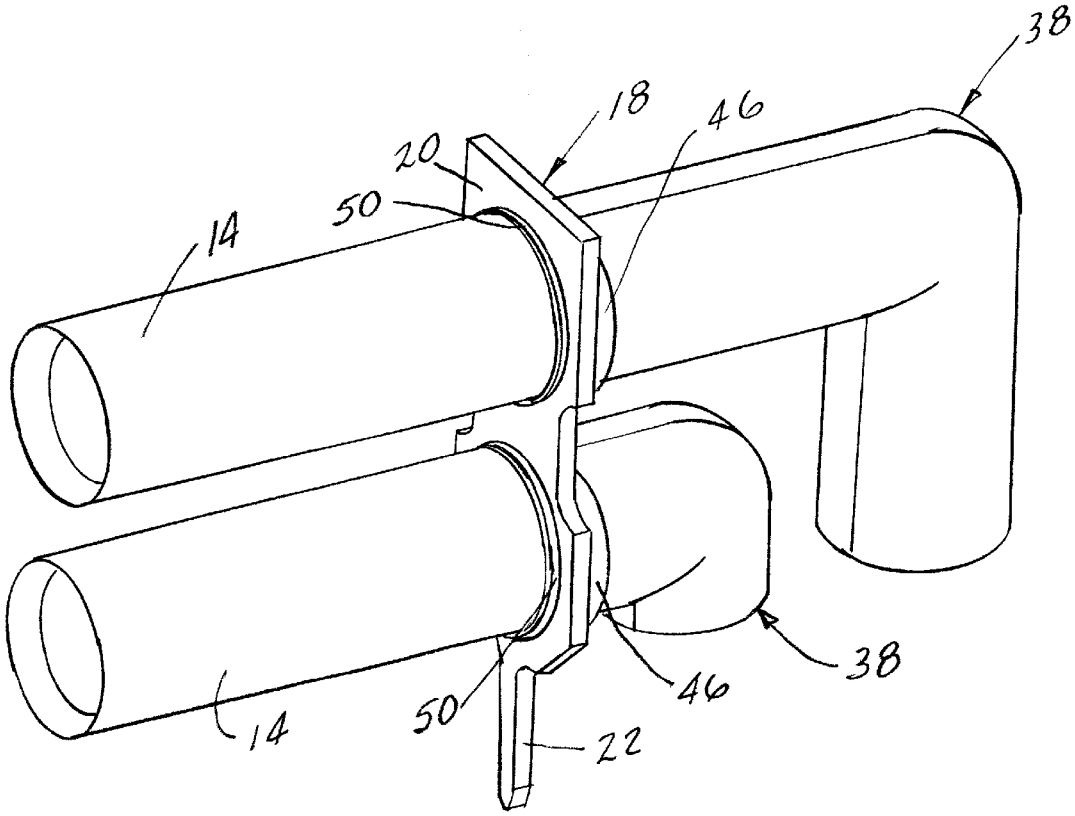
FIG. 5 is a perspective view showing the subassemblies of FIGS. 3 and 4 in assembly.

FIG. 5 shows the subassembly of FIG. 3 inserted into the rear of the subassembly of FIG. 4. In other words, reduced-diameter portions 42 of rear shield portions 38 are inserted into rear portions 46 of front shield portions 14. When in the assembly of FIG. 5, the circumferentially continuous configuration of the front shield portions hold the axially split rear shield portions together.

An alternative arrangement may include a pair of axially split, L-shaped shields which would enclose the dielectric sheaths 26 and be held together with the grounding clip 18 or the like.

Figure 6:
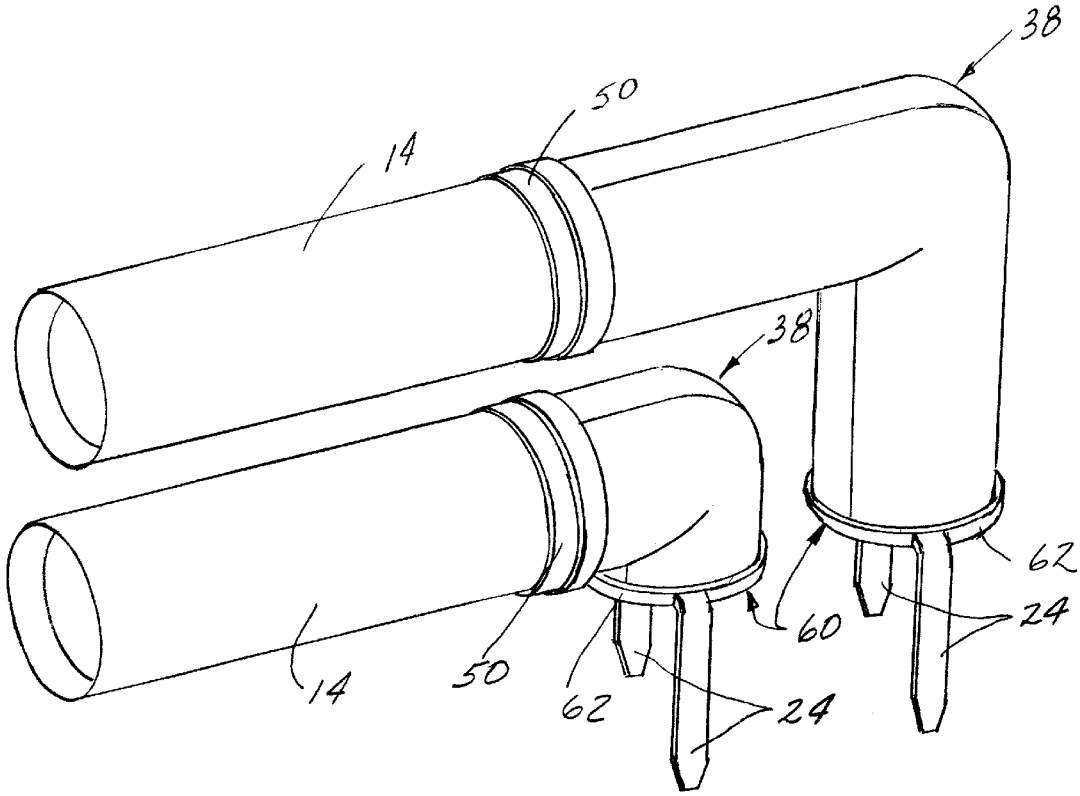
FIG. 6 is a perspective view similar to that of FIG. 5, with the grounding clip of FIG. 5 removed, and with a pair of auxiliary grounding clips installed.

FIGS. 6 and 7 show two additional grounding clips, generally designated 60, which include the tail portions 24 described above in relation to FIG. 1. The tail portions project downwardly from a ring-like mounting portion 62 for each grounding clip 60. As seen in FIG. 7, the ring-like mounting portion 62 of each grounding clip surrounds a reduced-diameter portion 64 of the respective rear shield portion 38. The mounting portion can be held onto the reduced-diameter portion by a press-fit, for instance.

Figure 8:
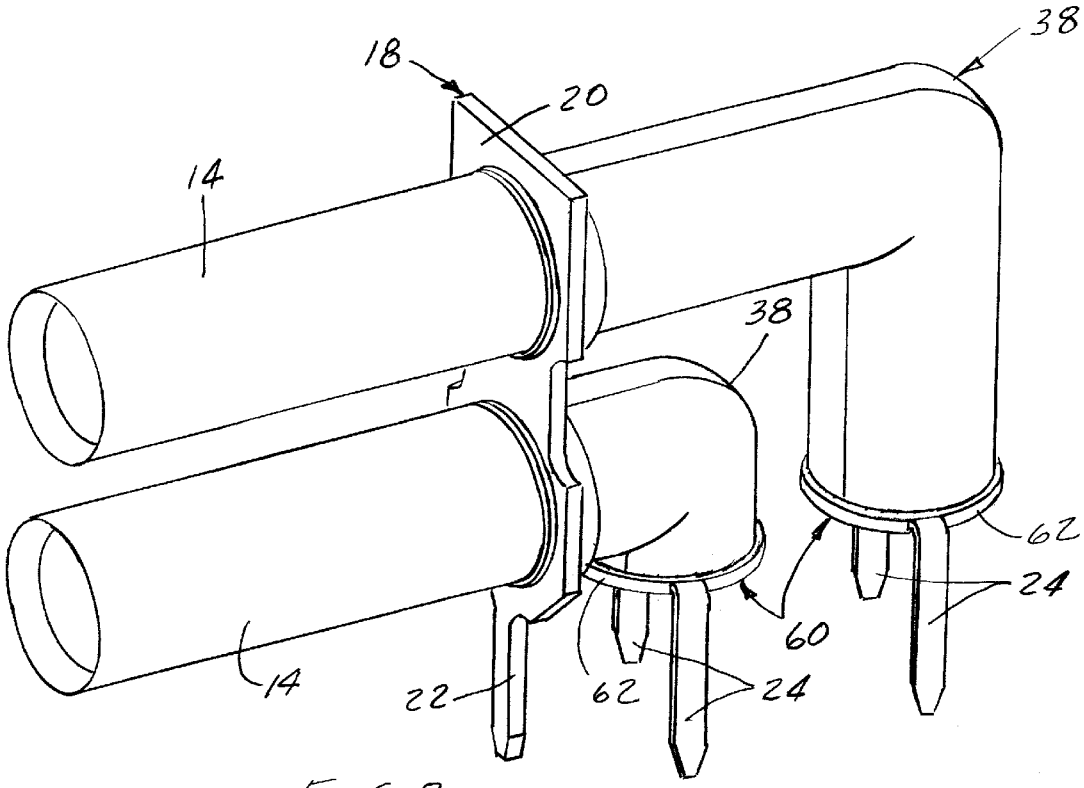
FIG. 8 is a perspective view showing the inclusion of the grounding clips in both FIGS. 5 and 6.

Grounding clip 18 (FIGS. 4 and 5) has been removed from FIGS. 6 and 7 to facilitate the illustration. It should be understood that both grounding clip 18 and grounding clips 60 can be used as shown in FIG. 8. By utilizing all of the grounding clips, a redundant grounding system is provided to ensure a good ground between the entire tubular shield of each coaxial conductor, including front shield portions 14 which are embraced by grounding clip 18 and rear shield portions 38 which are embraced by grounding clips 60.

Figure 9:
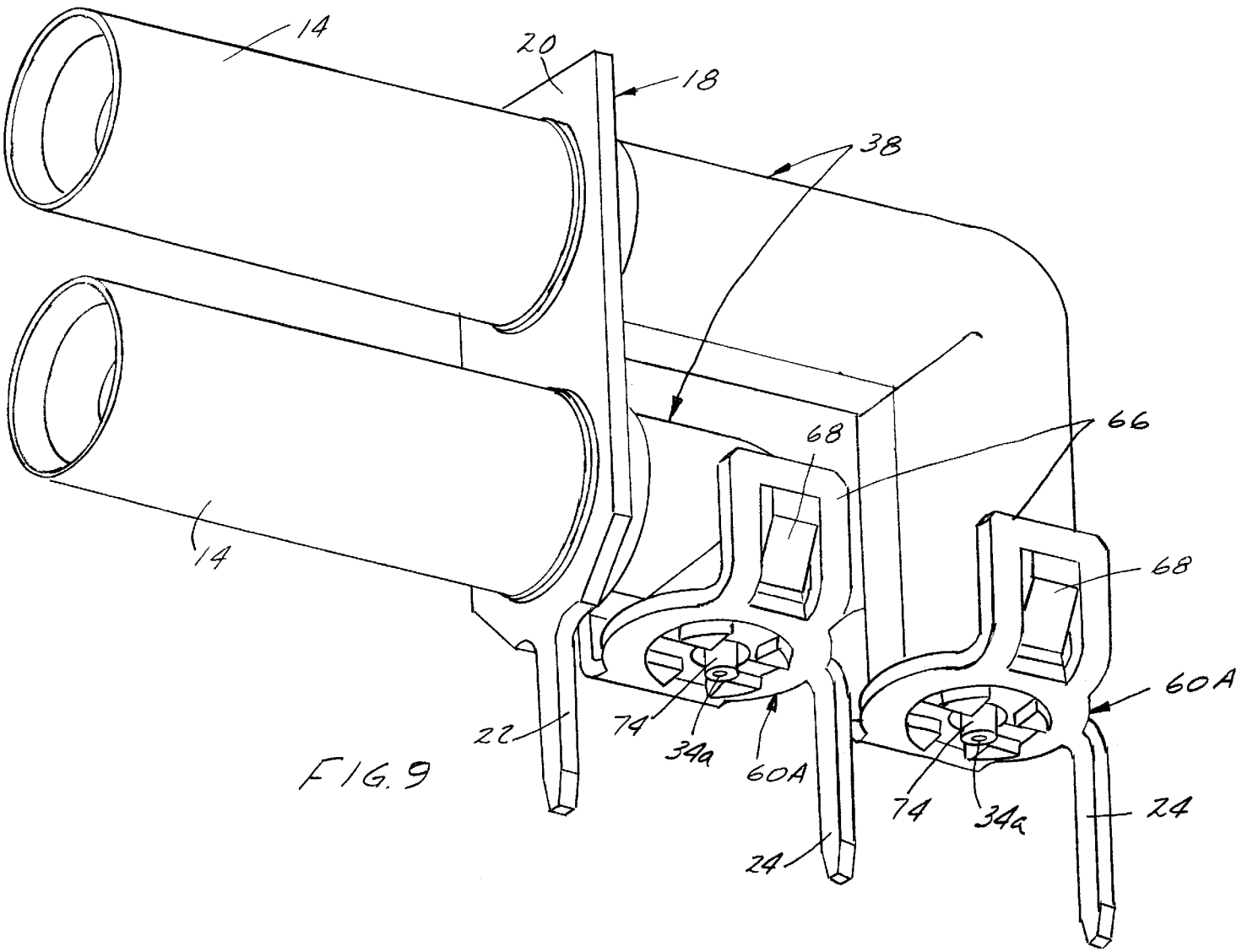
FIG. 9 is a perspective view similar to that of FIG. 8, but looking towards the bottom of the subassembly and showing an alternate form of the rear grounding clips.

FIG. 9 shows an alternate embodiment of grounding clips 60, and the grounding clips are generally designated 60A in FIG. 9. The alternate embodiment of grounding clips 60A include only one tail portion 24. A pair of inverted U-shaped latches 66 project upwardly from opposite sides of each grounding clip. The latches snap onto ramped latch bosses 68 formed on opposite sides of rear shield portions 38.

Figure 10:
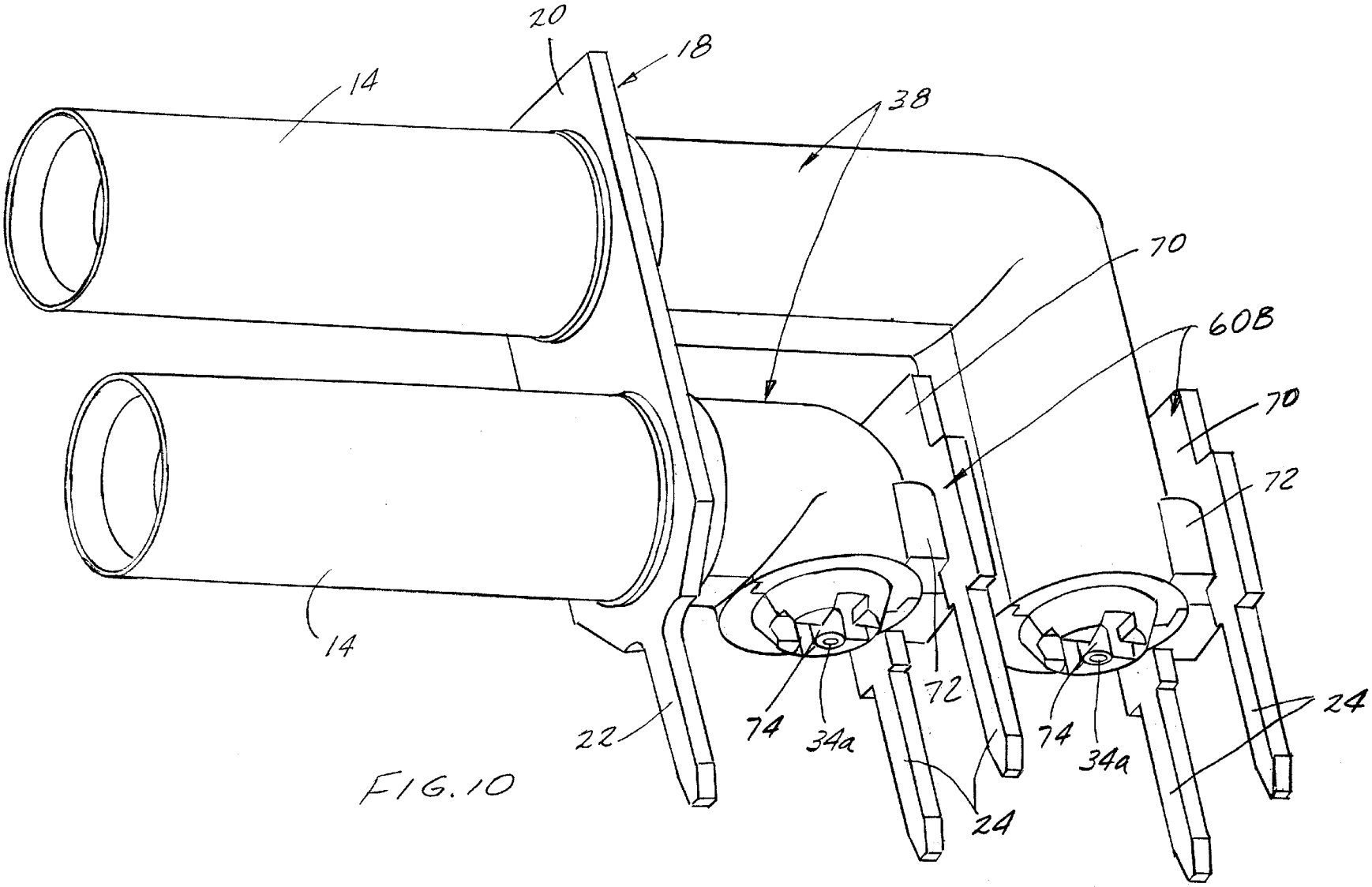
FIG. 10 is a view similar to that of FIG. 9, but showing a further alternate embodiment of the rear grounding clips.

FIG. 10 shows a further embodiment of grounding clips 60B which have inverted U-shaped body portions 70 which are snapped onto a pair of mounting bridges 72 formed integrally with rear shield portions 38 and projecting outwardly therefrom. Grounding clips 60B include a pair of the tail portions 24 for attachment to appropriate grounding circuit traces on the printed circuit board.

FIGS. 9 and 10 show a process for easily attaching coaxial conductors 32 (FIG. 7) to appropriate circuit traces on the printed circuit board. Specifically, FIG. 7 shows that distal ends 34*a* of legs 34 of coaxial conductors 28 and 30 are of reduced diameters. FIGS. 9 and 10 show a pair of preformed (cylindrical) solder plugs 74 which are press-fit over distal ends 34*a* of the coaxial conductors. These preformed solder plugs facilitate ready connection of the conductors to circuit traces on the printed circuit board by a surface-mount process. Of course, the invention contemplates that legs 34 of the angled coaxial conductors can extend further to comprise tail portions for insertion into appropriate holes in the printed circuit board and for connection, as by soldering, to circuit traces on the board and/or in the holes.

Figure 11:
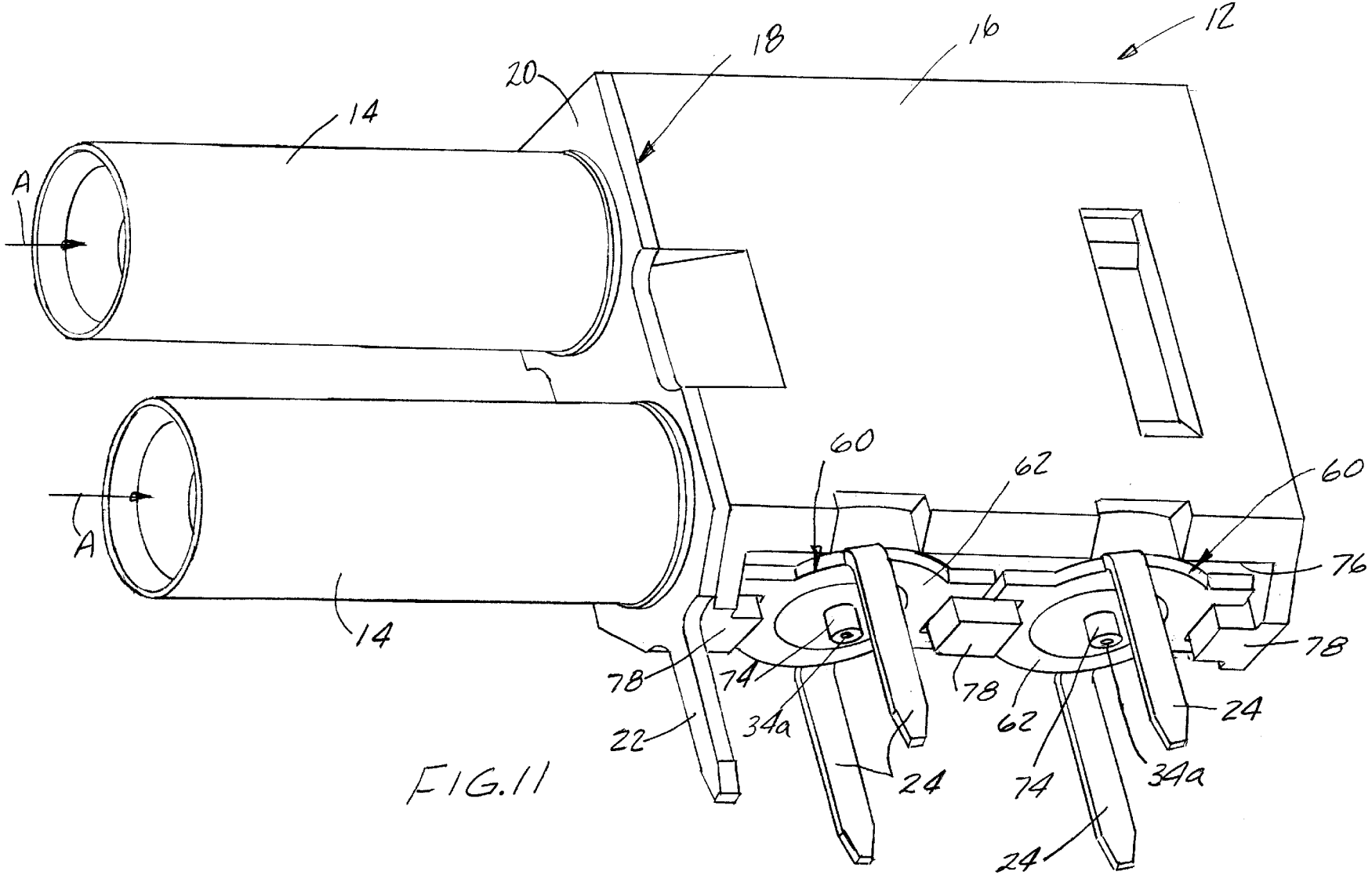
FIG. 11 is a perspective view of the completely fabricated angular coaxial connector module, similar to FIG. 1, but looking toward the bottom of the module.

FIG. 11 shows the final step of overmolding dielectric housing 16 over the subassembly of FIG. 8 (or FIG. 9 or 10) to form the completely fabricated coaxial connector module 12 initially described in relation to FIG. 1. The housing is overmolded in an appropriate molding die, leaving the bottom of the housing open, as at 76, so that tail portions 24 of the grounding clips can project out of the housing, and preformed solder plugs 74 are exposed for soldering to the circuit traces on the printed circuit board. The bottom of the housing has portions 78 which define a mounting surface for positioning module 12 on the printed circuit board.

The overmolding of the individual coaxial conductors to form the module 12 as described is not necessary. If desired the individual coaxial conductors may be held together by the grounding clip 18, or individually may be inserted into receptacles of a housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An angular coaxial connector module for installation on a printed circuit board, comprising:

at least a pair of angled, coaxial conductors each including first and second legs joined at an elbow, a distal end of each first leg defining a contact end of the respective conductor, and a distal end of each second leg defining a terminal end for attachment to the printed circuit board;

an angled dielectric sheath overmolded about each angled coaxial conductor leaving the distal ends thereof exposed;

an angled tubular conductive shield about each dielectric sheath;

grounding means for coupling the shields to the printed circuit board; and a unitary dielectric housing about at least portions of the shields to hold the connector in a module.

2. The coaxial connector module of claim 1 wherein each of said tubular conductive shields includes a circumferentially continuous portion about one leg of the respective conductor leaving the respective distal end of the one leg exposed.

3. The coaxial connector module of claim 1 wherein said grounding means comprises at least one grounding clip having at least one tail portion for attachment to the printed circuit board.

4. The coaxial connector module of claim 1 wherein said housing comprises a one-piece plastic structure overmolded about at least portions of the shields.

5. The coaxial connector module of claim 1 wherein said tubular conductive shields are generally cylindrical in cross-section.

6. The coaxial connector of claim 5 wherein each of said tubular shield is axially split.

7. An angular coaxial connector module for installation on a printed circuit board, comprising:

at least a pair of angled coaxial conductors each including first and second legs joined at an elbow, the distal end of each first leg defining a contact end of the respective conductor, and a distal end of each second leg defining a terminal end for attachment to a printed circuit board;

a dielectric sheath overmolded in tubular form about each angled coaxial conductor leading the distal ends thereof exposed;

a tubular conductive shield about each dielectric sheath, each shield including an axially split, L-shaped portion about one leg and the elbow of the respective conductor leaving the distal end of the one leg exposed, a circumferentially continuous portion about the other leg leaving the distal end of the other leg exposed, and the circumferentially continuous portion having an end surrounding an adjacent end of the axially split portion to hold the axially split portion together;

at least one grounding clip having at least one tail portion for attachment to the printed circuit board; and a one-piece plastic housing overmolded about at least portions of the shields to hold the connector in a module.

8. The coaxial connector module of claim 7 wherein said shield portions of the tubular conductive shield are generally cylindrical in cross-section.

9. The coaxial connector module of claim 7, including one of said grounding clips embracing each conductive shield.

10. The coaxial connector module of claim 7 wherein said grounding clip includes a body portion embracing the conductive shields of both coaxial conductors.

11. An angular coaxial connector module for installation on a printed circuit board, comprising:

at least a pair of angled coaxial conductors each including first and second legs joined at an elbow, a distal end of each first leg defining a contact end of the respective conductor, and a distal end of each second leg defining a terminal end for attachment to the printed circuit board;

an angled dielectric sheath overmolded about each angled coaxial conductor leaving the distal ends thereof exposed;

an angled conductive shield about each dielectric sheath; and a unitary dielectric housing about at least portions of the shields to hold the connector in a module.

12. The coaxial connector module of claim 11 wherein said grounding means comprises at least one grounding clip having at least one tail portion for attachment to the printed circuit board.

13. The coaxial connector module of claim 11 wherein said housing comprises a one-piece plastic structure overmolded about at least portions of the shields.

14. A method of fabricating an angular coaxial connector module for installation on a printed circuit board, comprising:

providing at least a pair of angled coaxial conductors each including first and second legs joined at an elbow, a distal end of each first leg defining a contact end of the respective conductor, and a distal end of each second leg defining a terminal end for attachment to the printed circuit board;

overmolding an angled dielectric sheath about each angled coaxial conductor leaving the distal ends thereof exposed;

positioning an angled tubular conductive shield about each dielectric sheath;

positioning a grounding means on the shields for connection to the printed circuit board; and providing a unitary dielectric housing about at least portions of the shields to hold the connector in a module.

15. The method of claim 14 including overmolding said housing in a one-piece plastic structure about at least portions of the shields.

16. A method of fabricating an angular coaxial connector module for installation on a printed circuit board, comprising:

providing at least a pair of angled coaxial conductors each including first and second legs joined at an elbow, a distal end of each first leg defining a contact end of the respective conductor, and a distal end of each second leg defining a terminal end for attachment to the printed circuit board;

overmolding an angled dielectric sheath about each angled coaxial conductor leaving the distal ends thereof exposed;

positioning an angled tubular conductive shield about each dielectric sheath; and positioning a grounding means on the shields for connection to the printed circuit board.

17. An angular coaxial connector module for installation on a printed circuit board, comprising:

at least a pair of angled coaxial conductors each including first and second legs joined at an elbow, a distal end of each first leg defining a contact end of the respective conductor, and a distal end of each second leg defining a terminal end for attachment to the printed circuit board;

an angled dielectric sheath overmolded about each angled coaxial conductor leaving the distal ends thereof exposed;

an angled tubular conductive shield about each dielectric sheath; and a grounding means for coupling the shields to the printed circuit board.

18. The coaxial connector module of claim 17 wherein said tubular conductive shields are generally cylindrical in cross-section.

19. The coaxial connector module of claim 17 wherein each of said tubular conductive shields is axially split.

20. A angular coaxial module for installation on a printed circuit board, comprising:

at least a pair of angled coaxial conductors each including first and second legs joined at an elbow, a distal end of each first leg defining a contact end of the respective conductor, and a distal end of each second leg defining a terminal end for attachment to the printed circuit board;

a dielectric sheath about each angled coaxial conductor leaving the distal ends thereof exposed;

a tubular conductive shield about each dielectric sheath, each tubular conductive shield including an axially split, L-shaped portion about one leg and the elbow of the respective conductor leaving the distal end of the one leg exposed;

grounding means for coupling the shields to the printed circuit board; and a unitary dielectric housing about at least portions of the shields to hold the connector in a module.

21. The coaxial connector module of claim 20 wherein each of said tubular conductive shields includes a circumferentially continuous portion about the other leg of the respective conductor leaving the distal end of the other leg exposed.

22. The coaxial connector module of claim 21 wherein said circumferentially continuous portion of each shield includes an end surrounding an adjacent end of the axially split portion of the shield to hold the axially split portion together.

23. An angular coaxial connector module for installation on a printed circuit board, comprising:

at least a pair of angled coaxial conductors each including first and second legs joined at an elbow, a distal end of each first leg defining a contact end of the respective conductor, and a distal end of each second leg defining a terminal end for attachment to the printed circuit board;

a dielectric sheath overmolded about each angled coaxial conductor leaving the distal ends thereof exposed;

a tubular conductive shield about each dielectric sheath;

grounding means for coupling the shields to the printed circuit board, including at least one grounding clip having at least one tail portion for attachment to the printed circuit board, the grounding clip having a body portion embracing the conductive shields of both coaxial conductors; and a unitary dielectric housing about at least portions of the shields to hold the connector in a module.

24. An angular coaxial connector module for installation on a printed circuit board, comprising:

at least a pair of angled coaxial conductors each including first and second legs joined at an elbow, a distal end of each first leg defining a contact end of the respective conductor, and a distal end of each second leg defining a terminal end for attachment to the printed circuit board;

a dielectric sheath about each angled coaxial conductor leaving the distal ends thereof exposed;

a conductive shield about each dielectric sheath, each conductive shield being tubular and including an axial split, L-shaped portion about one leg and the elbow of the respective conductor leaving the distal end of the one leg exposed, a circumferentially continuous portion about the other leg of the respective conductor leaving the distal end of the other leg exposed, said circumferentially continuous portion of each shield including an end surrounding an adjacent end of the axially split portion of the shield to hold the axially split portion together; and a unitary dielectric housing about at least portions of the shields to hold the connector in a module.

25. An angular coaxial connector module for installation on a printed circuit board, comprising:

at least a pair of angled coaxial conductors each including first and second legs joined at an elbow, a distal end of each first leg defining a contact end of the respective conductor, and a distal end of each second leg defining a terminal end for attachment to the printed circuit board;

a dielectric sheath overmolded about each angled coaxial conductor leaving the distal end thereof exposed;

a conductive shield about each dielectric sheath;

at least one grounding clip having a body portion embracing the conductive shields of both coaxial conductors and at least one tail portion for attachment to the printed circuit board; and a unitary dielectric housing about at least portions of the shields to hold the connector in a module.

26. A method of fabricating an angular coaxial connector module for installation on a printed circuit board, comprising:

providing at least a pair of angled coaxial conductors each including first and second legs joined at an elbow, a distal end of each first leg defining a contact end of the respective conductor, and a distal end of each second leg defining a terminal end for attachment to the printed circuit board;

positioning a dielectric sheath about each angled coaxial conductor leaving the distal ends thereof exposed;

positioning a tubular conductive shield about each dielectric sheath, each conductive shield including an axially split, L-shaped portion about one leg and the elbow of the respective conductor leaving the distal end of the one leg exposed, with a circumferentially continuous portion about the other leg of the respective conductor leaving the distal end of the other leg exposed, and with an end of the circumferentially continuous portion surrounding an adjacent end of the axially split portion to hold the axially split portion together;

positioning a grounding means on the shields for connection to the printed circuit board; and providing a unitary dielectric housing about at least portions of the shields to hold the connector in a module.

27. An angular coaxial connector module for installation on a printed circuit board, comprising:

at least a pair of angled coaxial conductors each including first and second legs joined at an elbow, a distal end of each first leg defining a contact end of the respective conductor, and a distal end of each second leg defining a terminal end for attachment to the printed circuit board;

a dielectric sheath about each angled coaxial conductor leaving the distal ends thereof exposed;

a tubular conductive shield about each dielectric sheath;

grounding means for coupling the shields to the printed circuit board, including at least one grounding clip embracing each conductive shield and having at least one tail portion for attachment to the printed circuit board, the grounding clip having a body portion embracing the conductive shields of both coaxial conductors; and a unitary dielectric housing about at least portions of the shields to hold the connector in a module.

28. An angular coaxial connector module for installation on a printed circuit board, comprising:

at least a pair of angled coaxial conductors each including first and second legs joined at an elbow, a distal end of each first leg defining a contact end of the respective conductor, and a distal end of each second leg defining a terminal end for attachment to the printed circuit board;

a dielectric sheath about each angled coaxial conductor leaving the distal end thereof exposed;

a conductive shield about each dielectric sheath;

at least one grounding clip embracing each conductive shield and having a body portion embracing the conductive shields of both coaxial conductors and at least one tail portion for attachment to the printed circuit board; and a unitary dielectric housing about at least portions of the shields to hold the connector in a module.

* * * * *